US006778094B2

(12) United States Patent
Gustason et al.

(10) Patent No.: US 6,778,094 B2
(45) Date of Patent: Aug. 17, 2004

(54) MOTION DETECTION APPARATUS AND METHOD

(75) Inventors: Michael L. Gustason, Tehachapi, CA (US); David R. Hertwig, Diamond Bar, CA (US); Patrick M. Krugh, Burbank, CA (US); Susan M. Ross, La Crescenta, CA (US); Timothy W. Stone, LaCrescenta, CA (US)

(73) Assignee: Disney Enterprises, Inc., Burbank, CA (US)

( * ) Notice: Subject to any disclaimer, the term of this patent is extended or adjusted under 35 U.S.C. 154(b) by 149 days.

(21) Appl. No.: 09/954,865

(22) Filed: Sep. 18, 2001

(65) Prior Publication Data

US 2003/0052793 A1 Mar. 20, 2003

(51) Int. Cl.[7] ..... G08B 23/00
(52) U.S. Cl. ..... 340/693.9; 73/489; 73/493
(58) Field of Search ..... 340/693.9, 429, 340/967, 440, 671, 669, 689; 701/1, 3, 5; 180/282; 73/489, 493, 514.01

(56) References Cited

U.S. PATENT DOCUMENTS

| | | | | |
|---|---|---|---|---|
| 4,114,450 A | * | 9/1978 | Shulman et al. | 73/489 |
| 4,531,701 A | | 7/1985 | Treu | 248/676 |
| 4,873,867 A | * | 10/1989 | McPherson et al. | 73/493 |
| 5,097,706 A | | 3/1992 | Le Nouvel et al. | 73/493 |
| 5,212,984 A | | 5/1993 | Norling et al. | 73/493 |
| 5,481,901 A | * | 1/1996 | Huang | 73/1.41 |
| 6,122,959 A | * | 9/2000 | Hoshal et al. | 73/489 |
| 6,215,672 B1 | * | 4/2001 | Warner et al. | 361/785 |
| 6,561,027 B2 | * | 5/2003 | Rendahl et al. | 73/493 |

* cited by examiner

*Primary Examiner*—John Tweel
(74) *Attorney, Agent, or Firm*—Hogan & Hartson, LLP

(57) ABSTRACT

A motion detection apparatus and method for securing a detector, transducer or accelerometer. The detector is securely positioned in a location corresponding to a portion of the body such as the head, stomach, heart, sternum, or other portion. The mounting apparatus includes a base section to which the detector is secured and support members. Support members can have a fixed-length or be extendable. The support members are adjusted if necessary to position the mounting apparatus and detector to the predetermined position.

76 Claims, 16 Drawing Sheets

MOTION DETECTION APPARATUS AND METHOD

FIELD OF THE INVENTION

This invention relates in general to motion test devices, and in particular, to a motion detection system with a mounting apparatus for a vehicle, ride, or moving object which secures a motion detector in a predetermined position.

DESCRIPTION OF RELATED ART

The effects of motion (e.g., speed, acceleration, deceleration, gravity, directional changes) upon riders in a vehicle, ride, or other moving object can result in motion sickness, illnesses, or trigger more serious health problems such as a heart attack. Acceleration or deceleration values are defined in terms of "g" or the ratio of a given acceleration divided by a reference acceleration of the earth's gravity. One g=32.2 ft/s$^2$. Jerk is defined as the time rate of change of acceleration and is usually represented in units of g/s. Motion Sickness Incidence (MSI) is defined as the percentage of test subjects that would become sufficiently sick to vomit. The duration, direction, and magnitude of these forces can be measured and analyzed to determine the effects upon a human body.

Different portions of the body can be impacted by these forces more significantly than other body portions. For example, the head, heart, or stomach can be more susceptible to illnesses, sickness, or injury. Forces upon these body portions can be measured to determine whether potential injury or illness may result.

Conventional motion detection systems, however, do not effectively secure a detection device to a vehicle or ride or are capable of being used with a limited number of vehicle designs or configurations. Some detector mounting arrangements are not adaptable to different vehicle configurations, seating arrangements, or structures available for mounting purposes. Further, some conventional mounting systems do not account for other ride or vehicle variables such as rider or passenger position, restraints, seat design, etc., all of which can potentially impact the physical response of a rider or passenger. Attempting to use currently available mounting systems for different vehicles or vehicle configurations can result in insecure mounting of the detector. Consequently, sensitive motion detectors such as a transducer or accelerometer may record inaccurate data.

One example mounting system for accelerometers is used in automobiles to determine forces exerted on an anthropomorphic or "crash test" dummy during automobile crash testing. Accelerometers are incorporated into particular locations or cavities of a crash test dummy, e.g., the heart and thoracic region. However, these mounting systems are typically limited to use within a crash test dummy rather than being incorporated into actual vehicles or into different vehicle types, models, designs or configurations.

Thus, incorporating currently available mounting systems into vehicles, rides, or other moving objects may result in the accelerometer not being fully secured with the consequence of inaccurate data. Additionally, different structural or mounting components and design changes may be needed to incorporate current motion detection systems and mounting apparatus into different vehicle or ride configurations.

Accordingly, there is a need in the art for a motion detection system and mounting apparatus that effectively secures a motion detector such as an accelerometer to various vehicle or ride designs, configurations, and available mounting structures.

SUMMARY OF THE INVENTION

An apparatus for securing a motion detector to a vehicle includes support members which can be adjusted to position a motion detector in a predetermined position. The mounting apparatus includes a base section to which a motion detector is secured. The mounting apparatus also includes a plurality of support members coupled to the base section. The support members are adjusted if necessary to position the motion detector into the predetermined position based on a position of a person that would occupy the vehicle.

BRIEF DESCRIPTION OF THE DRAWINGS

Referring now to the drawings in which like reference numbers represent corresponding parts throughout.

DETAILED DESCRIPTION

In the following description of embodiments of the invention, reference is made to the accompanying drawings which form a part hereof, and which is shown by way of illustration specific embodiments in which the invention may be practiced. It is to be understood that other embodiments may be utilized as structural changes may be made without departing from the scope of the present invention.

One embodiment provides a mounting apparatus for positioning a sensor, detector, transducer, accelerometer, or other motion detection device in a secure manner. For simplicity, this specification refers to accelerometers, but different detection devices can also be utilized.

An accelerometer is secured within or to a vehicle such as an automobile, amusement park ride or other movable object. For simplicity, this specification refers to motion detection systems for amusement park rides or rides generally, other vehicles and moving objects can also be utilized. The mounting apparatus is adaptable to different ride configurations, mounting structures, and sizes to securely position the accelerometer. As a result, movements of the accelerometer are minimized to insure accurate motion data. With an adaptable mounting apparatus, the accelerometer can be placed in different positions, e.g., in a predetermined position corresponding to the head, chest, stomach, heart, or other portion of the body. However, for simplicity, this specification refers to measuring forces upon a heart of a person as an illustrative example. Once securely positioned, the ride can be activated and the resulting forces upon the heart can be measured and analyzed to determine the effects of those forces upon the rider.

Figure 1:
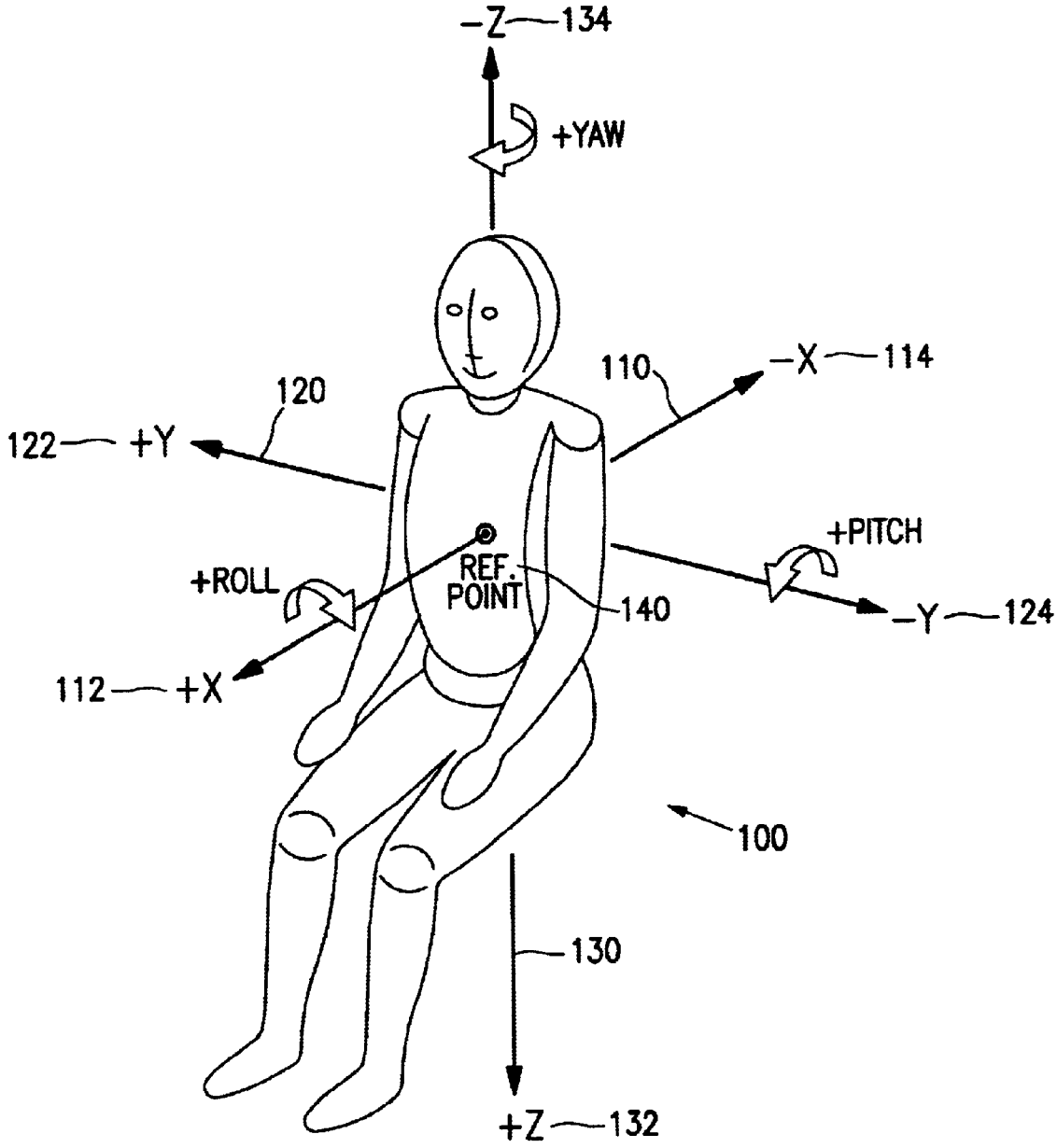
FIG. 1 is an illustration of potential motion forces.

For example, referring to FIG. 1, a rider 100 may be subject to forces along one, two, or three axes from different directions at different stages of the ride. An axis through the front and back of a rider 100 is identified as the "x axis" 110 A force along the x axis 110 is referred to as a roll force. A roll force can be a positive roll force 112 or a negative roll force 114 depending on its direction. An axis through the sides of rider 100 is identified as the "y axis" 120. A force along the y axis 120 is referred to as a pitch force. Similar to roll forces, a pitch force can be a positive pitch force 122 or a negative pitch force 124 depending on its direction. Finally, an axis along a length of a rider is identified as the "z axis" 130. A force along the z axis 130 is a yaw force. A yaw force can be a positive yaw force 132 or a negative yaw force 134 depending on its direction.

Roll, pitch, and yaw forces can be measured with respect to a particular point on or within a person, i.e., with respect to a reference point REF POINT 140. For example, as illustrated in FIG. 1, the reference point 140 at which forces are measured can correspond to the heart of the rider 100 with the three axes 110, 120, 130 meeting in the middle of the chest of the rider 100. Of course, forces can be measured at different reference points 140 corresponding to different portions of the rider's body.

Motion Detection System

Figure 2:
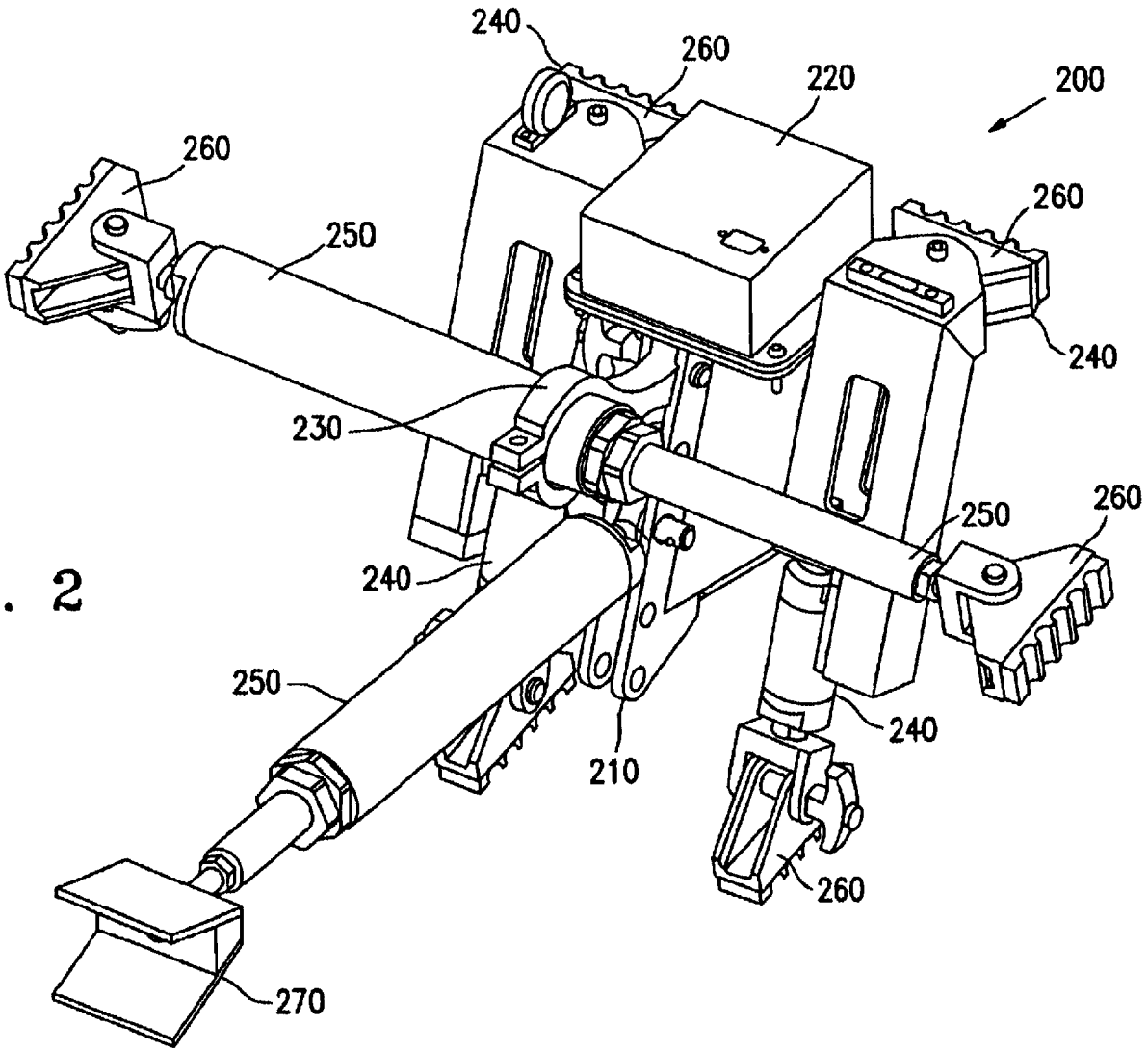
FIG. 2 is a front view of one embodiment of a motion detection system with a mounting apparatus and a motion detector secured in a predetermined position.

FIG. 2 illustrates one embodiment of a motion detection system 200 that utilizes a mounting apparatus to secure an accelerometer and detect motion forces. The mounting apparatus of the mounting system 200 includes a base section 210 to which an accelerometer 220 is secured, a coupler 230, support members, e.g., fixed-length support members 240 and adjustable-length support members 250, and attachments to support member such as a foot 260 or claw 270. The base section 210 secures the accelerometer 220. A plurality of support members can be attached to the base section 210 directly or indirectly through the coupler 230. Support members can be designed in different sizes, extendable lengths, and configurations (e.g., different types of fixed-length support members and different types of adjustable-length support members).

Various types of fixed-length support members 240 can be utilized in the mounting apparatus. For example, a back rest or a stanchion can form all or a portion of a fixed-length support member. Adjustable-length support members 250 can be configured in different directions for contact with different surfaces of the ride. Fixed-length or adjustable-length support members can include a foot 260 with a pad, cushion, or other material to prevent movement of the support member/foot against a vehicle surface. A support member can also have a securing appendage such as a claw 270, hook, clamp or other similar device. Following is a more detailed description of the mounting apparatus components of the motion detection system 200.

Base Section

Figure 3:
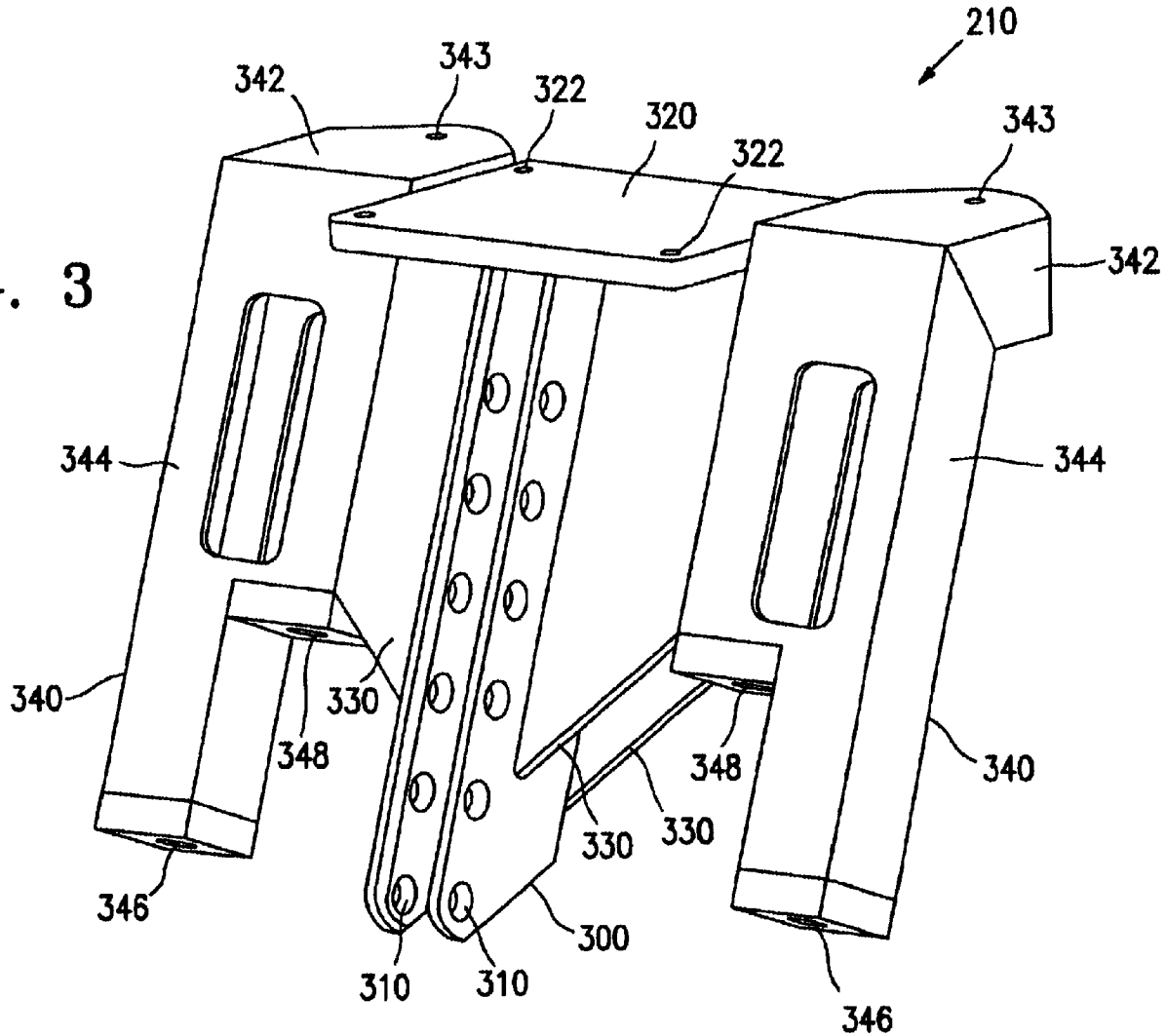
FIG. 3 is a front view of a base section of the mounting apparatus.

FIG. 3 illustrates the base section 210 apart from the other mounting apparatus components. The base section 210 includes plates 300 with connection points or holes 310, a flange 320, side plates 330, and legs 340.

The flange 320 is attached to the top of the side plates 330 and configured with holes 322. The accelerometer 220 is attached to the flange 320 via holes 322. Specifically, the accelerometer 220 can be mounted to a plate, and the accelerometer/plate combination can be mounted to the flange 320 through holes 322.

Figure 4A:
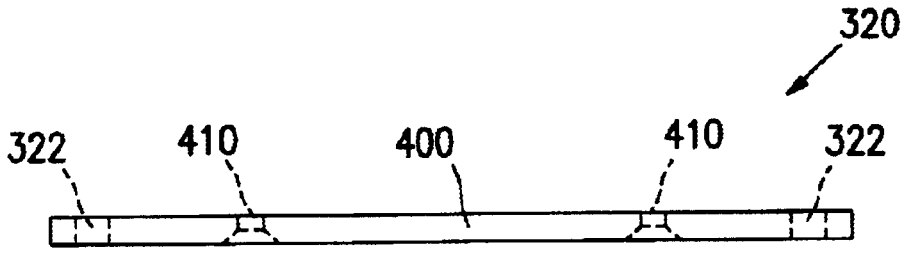
FIGS. 4A–B are respective side and top views of a flange of the base section of the mounting apparatus to which a motion detector is secured.
Figure 4B:
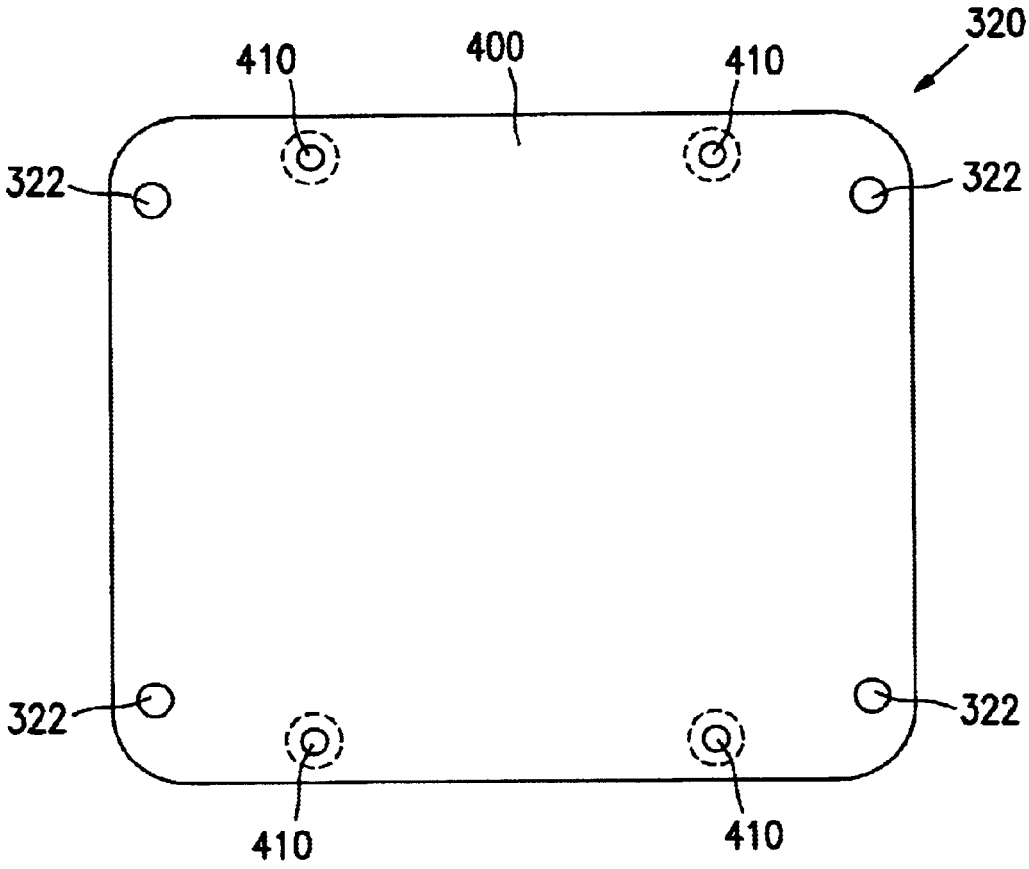

FIGS. 4A–B illustrate more detailed side and top views of the flange 320. Specifically, holes 322 are illustrated in FIG. 2 and used to mount the plate/accelerometer combination to the flange 320. Fasteners that secure the plate and accelerometer together may protrude from the bottom of the plate/accelerometer combination. Holes 410 can be shaped compensate for any fasteners that rest above the surface of the plate in the plate/accelerometer combination.

Referring back to FIG. 3, the legs 340 are connected to the side plates 330. FIG. 3 illustrates two legs 340 coupled to the side plates 330 of the base section 210. In the illustrated example, the support legs 340 include two tube sections—a first, top, or shorter tube section 342 and a second, bottom, or longer tube section 344.

The top tube section 342 is configured for attachment of a support member through hole 343. The bottom tube section 344 is configured for attachment of one or more support members via ports 346 and/or 348. A support member is coupled to a port of the bottom tube section 344 and secured with a fastener on the opposite side of the port. FIG. 3 illustrates ports 346 and 348 at different levels, however, the support legs 340 can also be configured with ports at the same level. Further, a single connection port can be utilized instead of multiple connection ports. Additionally, FIGS. 2 and 3 illustrate top and bottom tube sections forming an angled support leg 340. However, the support legs 340 can be configured as a straight tube section depending on the type of vehicle or ride to be tested and the support members utilized.

Referring back to FIG. 2, support members are coupled to the base section via the connection points 310 of plates 300. For example, an adjustable-length support member 250 is attached to the middle connection point 310 of the plates 300. The example embodiment also illustrates an adjustable length support member 250 secured by the coupler 230 which is attached to a top connection point 310. The support member 250 secured by the coupler 230 is perpendicular to the support member 250 attached directly to the middle connection point 310. In other words, the support member 250 attached by the coupler 230 is directed to the sides of the ride whereas the support member 250 coupled directly to the front of the base section 210 is directed to the front of the ride.

Coupler

Figure 5A:
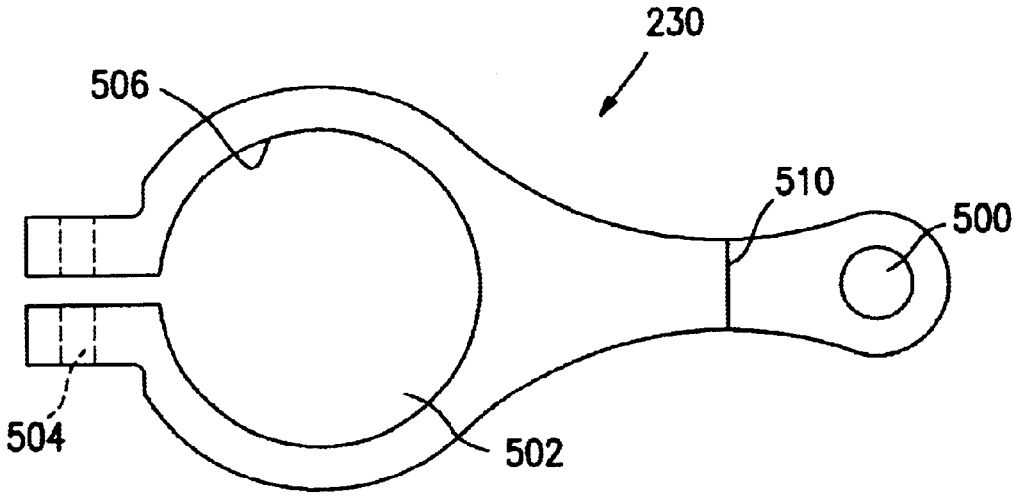
FIGS. 5A–B are respective top and side views of a coupler that is connected to the base section for securing a support member.
Figure 5B:
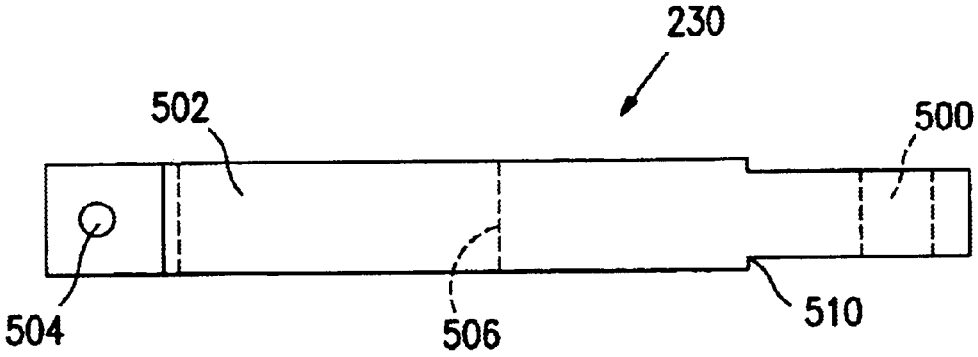
Figure 6A:
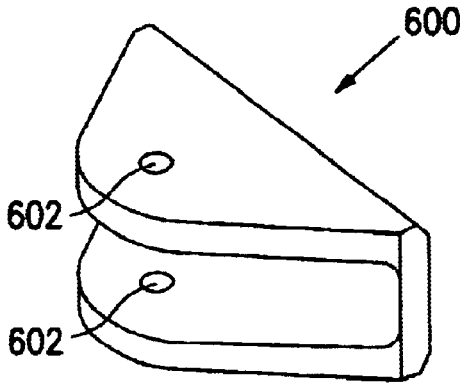
FIGS. 6A–D are respective front, top, side, and bottom views of a back rest, one example of a fixed-length support member of the mounting apparatus.
Figure 6B:
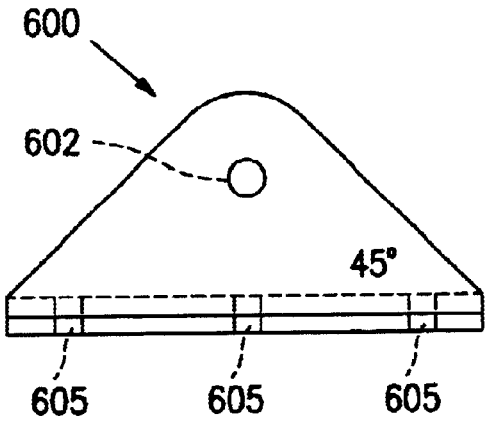
Figure 6C:
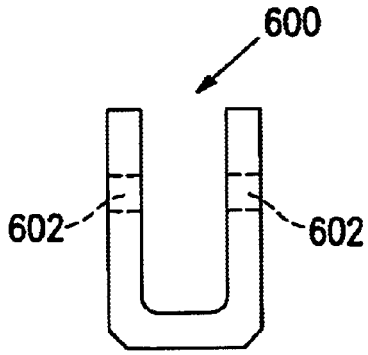
Figure 6D:
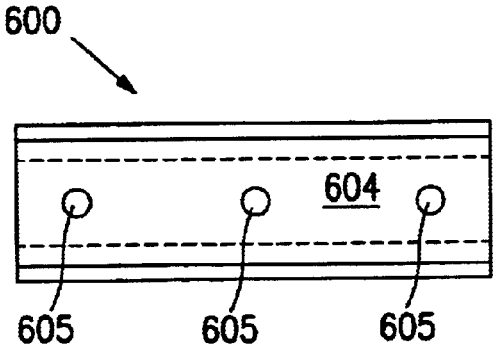

Referring back to FIG. 2 and to FIGS. 5A–B, the coupler 230 connected to the base section 210 to secure a support member 250 directed to sides of the ride. The coupler 230 can be various shapes, sizes, and forms, including the illustrated example coupler 230. The coupler includes a connection point 500, cavity 502, and a clamp 504.

The coupler 230 is attached to the base section 210 via the connection point 500. A support member 250 is placed within a cavity 502. A clamp 504 or fastener is tightened to secure the support member 250 against the inner surface 506 of the cavity 502.

As illustrated in FIG. 5B, the width of the coupler 230 is reduced at point 510 for placement between the plates 300 of the base section 210. However, different sizes and configurations of couplers 230 can be used depending on the configuration of the base section 210 and space between the plates 300 of the example base section 210 illustrated.

Fixed-Length Support Members

As previously explained, different types of support members can be used for positioning an accelerometer, including fixed-length support members. Referring to FIG. 3, fixed-length support members 240 are attached to the top tube section 342 of a support leg 340. These fixed-length support members 240 stabilize the mounting system 210 against a back of a ride surface (e.g., a seat back). FIG. 3 also illustrates a different type of fixed-length support member 240 directed to a bottom of a ride surface (e.g., a seat bottom, seat pan or ride floor). The ride surfaces that are used for mounting purposes can vary depending on the type and configuration of the ride and the type of fixed-length support members 240 utilized.

Fixed-length support members 240 can be designed in various forms and configurations. One type of fixed-length support member that is attached to the top tube section 342 of a support leg 340 is a back rest. A back rest can be various shapes, e.g., triangular, trapezoidal, square, and rectangular, etc. and include a rubber cushion, adhesive, or other material to prevent the backrest from sliding along the ride surface.

For example, FIGS. 6A–D illustrate perspective, top, side and bottom views of a backrest 600 with a rounded triangular shape. The backrest 600 is configured with attachment holes 602. A rod or bearing connects the back rest 600 and the top tube section 342 of the support arm 340 through holes 343 of the top tube section 342 and holes 602 of the back rest 600. In this configuration, the back rest 600 can be adjusted in two dimensions, e.g., the backrest 600 can swivel around a rod such that the angle of the backrest 600 can be adjusted for flat placement against the vehicle surface.

The bottom face 604 of the backrest 600 is configured with holes 605. A pad (e.g., a rubber pad), cushion, or other material to prevent movement of the back rest against a vehicle surface can be applied to the bottom face 600 via fasteners through holes 605 or with an adhesive.

A second example of a fixed-length support member 240 illustrated in FIG. 2 is coupled to the bottom tube section 344 of the support leg 340 through ports 346 and/or 348. This type of fixed-length support member 240 includes a stanchion or other support section, a foot, and a coupling device to connect the stanchion and the foot.

Figure 7A:
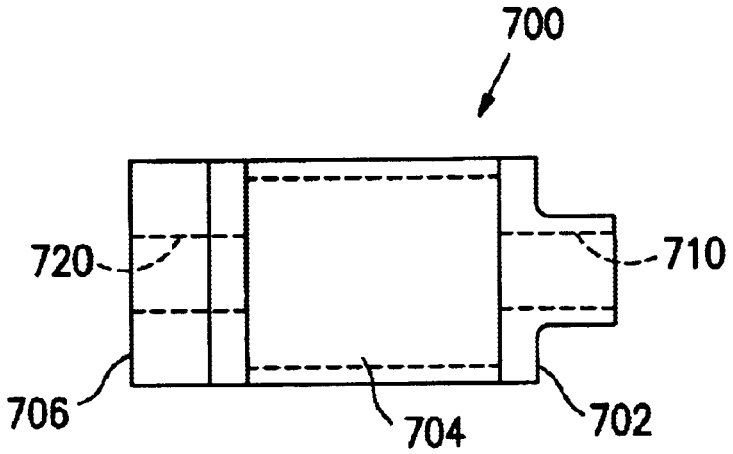
FIGS. 7A–B are side views of a stanchion utilized in a support member of the mounting apparatus.
Figure 7B:
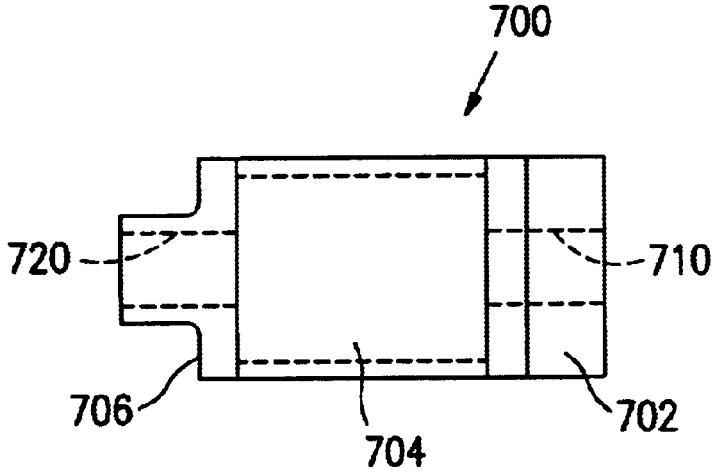

FIGS. 7A–B illustrate one example stanchion 700 in further detail. This stanchion 700 includes three sections: a top 702, a mid-section or tube 704, and a plate 706. The top 702 includes a hole 710 into which fasteners such as rivets can be inserted to couple the top of the stanchion 700 and the bottom tube section 344 of a leg 340 together through a port 346 or 348. The plate 706 includes a hole 720 for attachment to a clevis and a foot. A Helicoil insert is placed into the hole 720 to secure a threaded rod connecting the clevis and the foot to the stanchion 700. One example Helicoil insert that can be used is a ½-20 left hand Helicoil insert manufactured by McMaster Carr of McMaster-Carr Supply Company Corporation, Elmhurst, Ill. The Helicoil insert is placed in the hole 710 against a wall of the plate 706. The threaded portion of the rod end can be screwed into the Helicoil/hole 710 of the plate 706 of the stanchion 700 such that the plate 706 is securely fastened to the rod which is also coupled to the clevis.

Figure 8A:
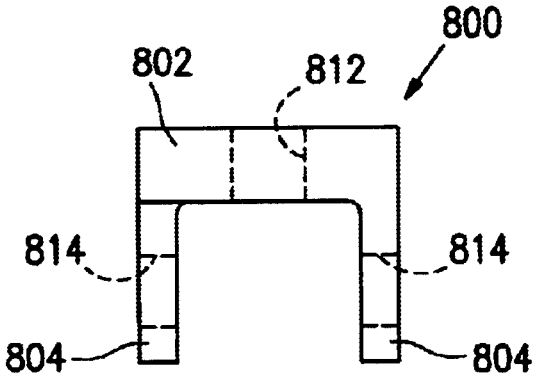
FIGS. 8A–C are respective top, side, and front views of a clevis that couples a foot to a support member.
Figure 8B:
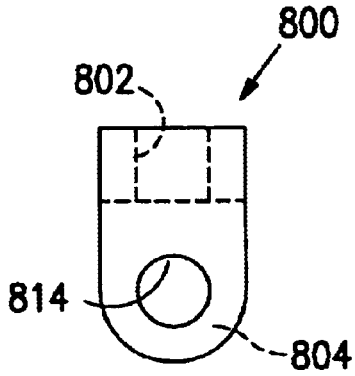
Figure 8C:
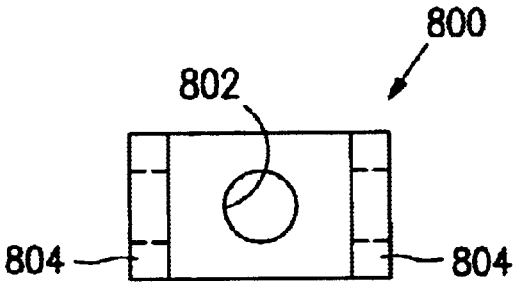
Figure 9A:
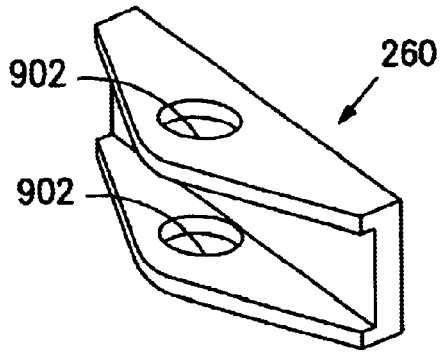
FIGS. 9A–D are respective front, top, side, and bottom views of a foot of a support member of the mounting apparatus.
Figure 9B:
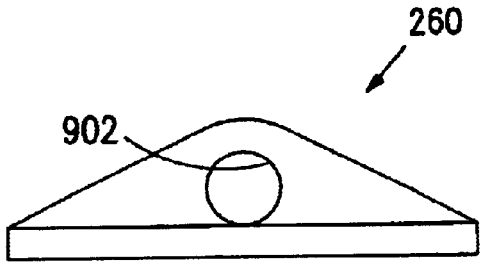
Figure 9D:
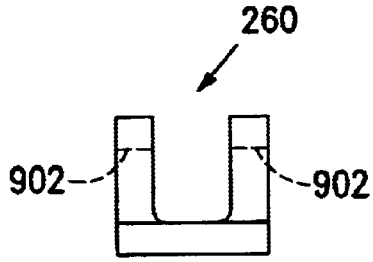
Figure 9C:
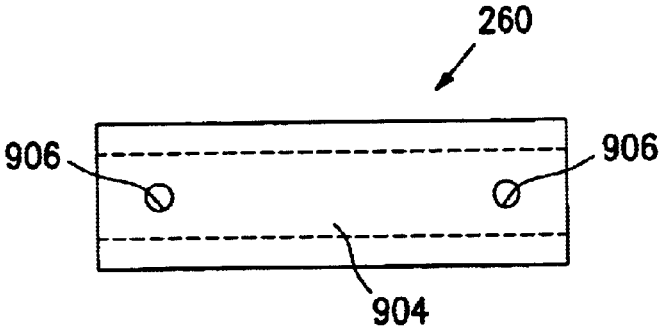

One example clevis is illustrated in FIG. 2 and in further detail in FIGS. 8A–C. The clevis 800 is a three-sided U-type coupler with holes through each of the three sides. Specifically, the clevis 800 includes a top section 802 and sides 804. The top section 802 includes a hole 812, and the sides each include a hole 814. The threaded rod that is secured to the stanchion 700 with a Helicoil insert is passed through the top hole 812. A fastener secures the stanchion 700, threaded rod, and clevis 800 together. The side holes 814 are available for attachment of a foot 260.

The foot 260 is illustrated in further detail in FIGS. 9A–D. FIGS. 9A–D illustrate perspective, front, bottom, and side views of the foot 260. The foot 260 can be various shapes, e.g., triangular, trapezoidal, square, and rectangular, etc. The foot 260 of FIGS. 9A–D is illustrated as a rounded triangular shape and may include a rubber cushion, pad, or other material to prevent the foot from sliding along the ride surface. The cushion can be applied to the base 904 with rivets or other fasteners through holes 906.

The foot 260 can be secured to the clevis 800/stanchion 700 using a T-handle. An example T-handle that can be utilized is the BLT-112 T-handle with quick release ball lock pins manufactured by Reid Tool Supply Company Corporation, Muskegon, Mich. The T-handle is passed through holes 804 of the clevis 800 and holes 902 of the foot 260. The T-handle may be secured with a Helicoil, a nut, a cotter pin, a clevis pin, a bearing or another fastener. Since the foot 260 is attached to a rod of the T-handle, the foot 260 may move around the rod for adjustment.

Indeed, other types and configurations of fixed-length support members can be utilized. Further, fixed-length support members can be attached to different portions of a base section, e.g., to an upper tube section, to a lower tube section, directly to the base section, or to a coupler which is attached to the base section.

Adjustable-Length Support Members

Adjustable-length support members 250 can be used in addition to or instead of fixed-length support members 240 to position an accelerometer. Adjustable-length support members can be attached directly to the base section 210 or indirectly through the coupler 230 or other attachment. If necessary, the adjustable support members can be adjusted, extended or recessed such that an end of the adjustable-length support member is placed against a surface of the ride.

One example of an adjustable support member includes one or more adjustable arm sections, e.g., a telescoping arm. An adjustable-length support member can be adjusted in two dimensions (length) or in three dimensions (length and angle) if the adjustable-length support member is rotatably coupled to the base section or leg with, for example, a bearing.

One type of adjustable-length support member 250 illustrated in FIG. 2 is coupled directly to the front of the base section 210. This support member 250 is extendable, if necessary, to contact a front surface, rail, or bar of the ride. This adjustable-length support member 250 includes hardware for coupling to the plates of the base section 210, an outer load lock barrel, an inner load lock barrel, an adjustment, such as a transtorque keyless bushing, to adjust the length of the inner load lock barrel extending from the outer load lock barrel interior, and an attachment such as a claw or hook to secure the support member to the front of the ride. These components are described in further detail below.

Figure 10A:
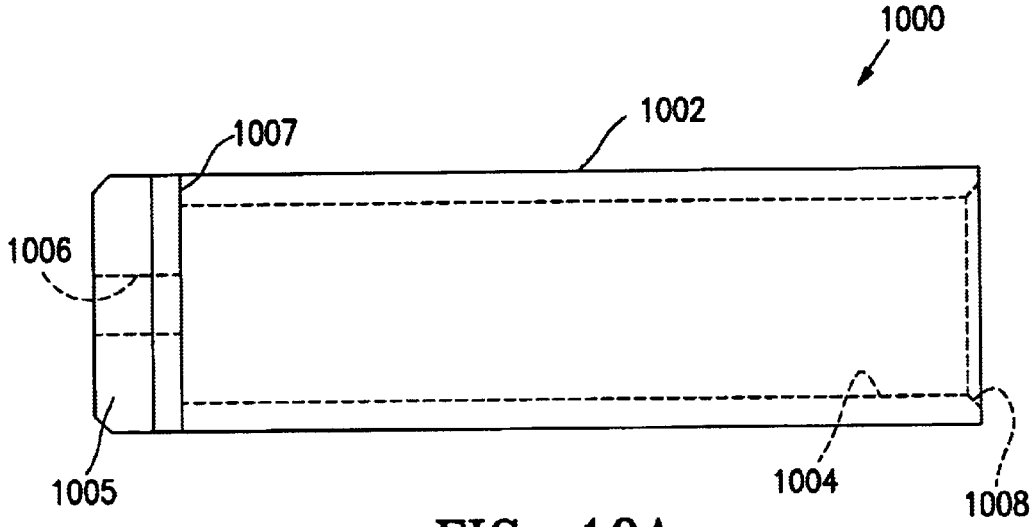
FIGS. 10A–B are side views of outer barrels of a support member.
Figure 10B:
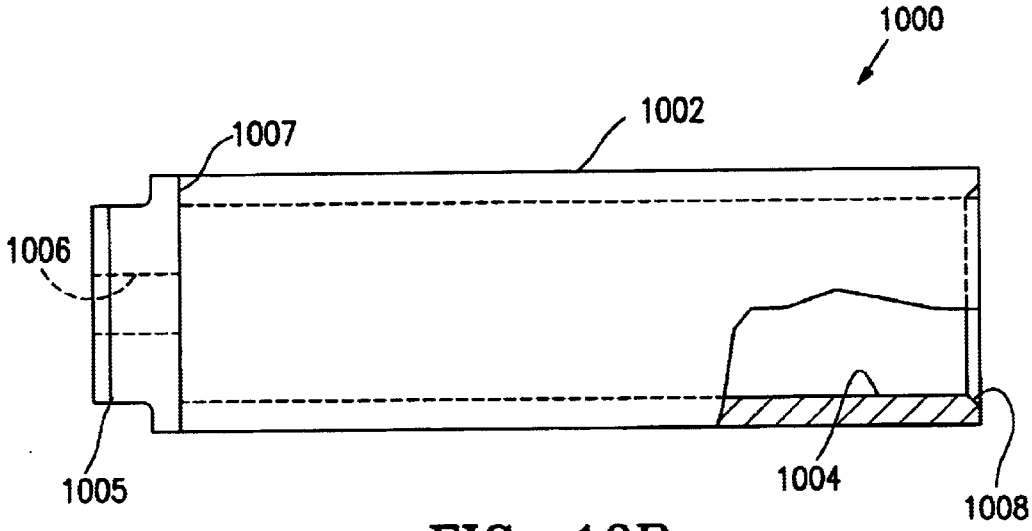

An outer load lock barrel (outer barrel 1000) is illustrated in FIG. 2 and FIGS. 10A–B. The outer load lock barrel 1000 is formed by a tube 1002. The interior diameter 1004 of the tube 1002 is sufficiently large to enable a smaller, inner barrel to be inserted within the outer load lock barrel.

Attached to one end of the outer barrel 1000 is a plate or cap 1005. The plate 1005 is secured to the outer barrel 1000 and configured with an opening or hole 1006 for a Helicoil insert. The Helicoil insert is placed in the hole 1006 against a wall 1007 of the plate 1005.

The Helicoil insert, a rod end, and a rod or T-handle are used to secure the outer barrel 1000 to the base section 210. The rod end includes a threaded rod portion and a head portion with a hole. The threaded rod portion of the rod end can be screwed into the Helicoil insert/hole of the plate 1005 of the outer barrel 1000 and fastened to the rod end/base section 201. The hole within the head of the rod end is placed between the plates 300 and aligned with two of the connection points 310. A T-handle is passed through the connection points and the hole of the rod end. Since the rod head can rotate around the body of the T-handle, the support member is capable of vertical or angle adjustment, i.e., movement in two dimensions. With different hardware, e.g., a bearing, the adjustable-length support member can be adjusted in three dimensions.

The other end of the outer barrel 1000 is configured for attachment of an adjustment device such as a transtorque keyless bushing. One example transtorque keyless bushing that can be utilized is manufactured by Fenner Drives™ of Manheim, Pa. The inner surface of the outer barrel 1000 is tapered 1008 if necessary for fitting of the transtorque keyless bushing within the inner diameter 1004 of the outer barrel 1000. With the configuration illustrated in FIG. 2, the transtorque keyless bushing nuts are accessible to a user.

Figure 11B:
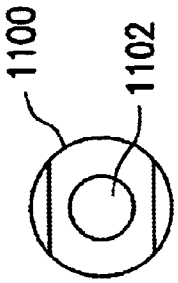
FIGS. 11A–B are respective side and front views of an inner barrel of a support member.
Figure 11A:
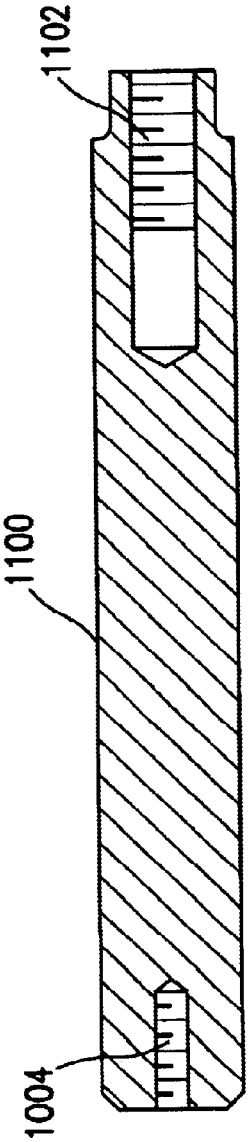

The inner load lock barrel is illustrated in FIGS. 2 and 11A–B. The length of the inner barrel 1100 can vary depending on the configuration of rides to be tested and support members utilized. For example, for full adjustment capability, the inner barrel 1100 can be the same length as the outer barrel 1000. In this case, the inner barrel 1100 can be completely recessed into the outer barrel 1000 or extended from the outer barrel 1000 so long as the inner surface of the transtorque keyless bushing makes sufficient contact with the inner barrel 1100 to secure the inner barrel 1100 within the transtorque keyless bushing.

An extendable support member can be adjusted as necessary to stabilize the mounting apparatus 200 against a front surface of a ride. In doing so, the inner barrel 1100 can be extended as far as the transtorque allows, and the length of the inner barrel 1100 can be recessed into the outer barrel 1000 for smaller ride dimensions.

Figure 12:
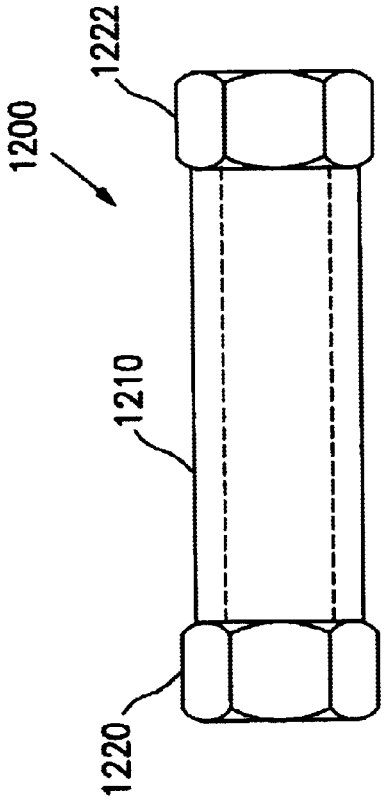
FIG. 12 is an illustration of a support member adjustment rod.

The inner barrel 1100 can be configured to incorporate an adjuster to modify the length of the inner barrel 1100. For example, referring to FIG. 12, the adjuster 1200 can include a threaded hole with which threaded stock 1210 can be lengthened or shortened to adjust the length/tension of the overall arm or support member. The threaded rod 1210 is locked by adjustable nuts 1220, 1222 at both ends of the threaded rod 1210.

Further, the inner barrel 1100 includes a threaded rod 1104 which is inserted within the body of the inner barrel 1100. The other end of the threaded rod 1104 is utilized for attachment of a foot, claw, or hook or other coupling device.

Figure 13B:
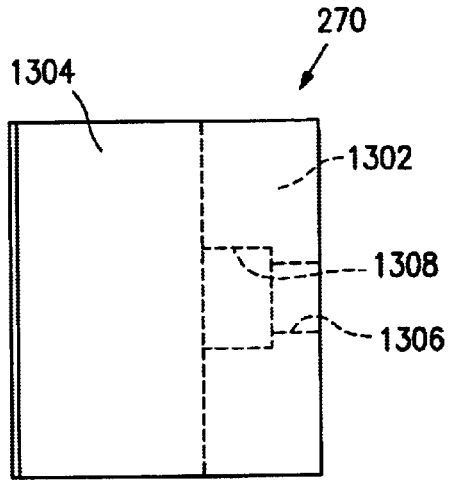
FIGS. 13A–C are respective side, top and front views of an attachment claw.
Figure 13C:
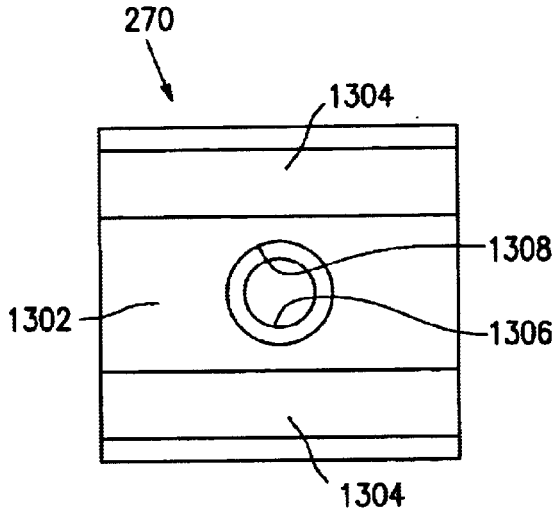
Figure 13A:
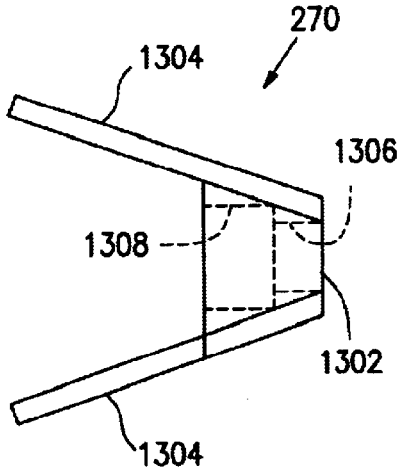

FIGS. 13A–C illustrate side, top, and front views of one example of a claw 270 that can be attached to an end of a fixed-length or adjustable-length support member. The claw 270 can be attached to the end of a support member directed to the front of the ride since the claw can grab onto handles or bars of a ride. However, if the ride does not include bars or other mounting structures suitable for the claw 270, a hook, a foot 260 as previously described or other device may be utilized.

The claw 270 in FIGS. 13A–C includes a base plate 1302 and two angled side plates 1304. The claw 270 is secured around a bar or handle such that the base 1302 contacts the bar or handle and the side plates 1304 limit the movement of bar or handle. If the bar is a horizontal bar, e.g., a bar between the sides of a ride, the claw 270 can be configured as illustrated in FIG. 13A to grasp the bar. If the bar is a vertical bar, the claw 270 can be rotated 90 degrees to grasp or grab the vertical bar. The base 1302 of the claw 270 includes a hole 1306 and a cavity 1308. The hole 1306 is sufficiently wide such that the threaded rod from the inner barrel 1100 passes through to the other side of the base 1302. The cavity 1308 provides space for a fastener to secure the threaded rod and the claw 270 together.

A second example of an adjustable-length support member is secured by the coupler 230 which is attached to the base section. This adjustable-length support member is directed to opposite sides of a ride whereas the previously described adjustable-length support member is directed to the front of the ride. Since the second type of adjustable-length support member is not attached directly to the base section, the coupling hardware previously described (e.g., a rod end, threaded rod, and Helicoil insert) are not utilized.

The mounting apparatus can be rotated 90 degrees such that the first support member is directed to one of the sides of the ride and the second support member is directed to the front and back of the ride. Thus, the first and second support members can be directed to adjacent sides of the ride.

Depending on how the mounting apparatus 200 is oriented, one of the support members may be longer than the other support member. For example, if the mounting apparatus 200 is configured for the front seat of an amusement park ride, the front or first adjustable support member directed to the front surface of the ride could be longer in length compared to the second or side adjustable-length support member. However, if the ride is wider than it is in length, then the second support member extending between the sides of the ride would be longer. In this case, the outer 1000 and inner 1100 barrels of the second support member can be longer to reach the side surfaces. Indeed, various configurations of the mounting apparatus 200 with different sized barrel components can be utilized.

The second example adjustable-length support member also utilizes an additional foot, claw, or other support device which contacts a side of the ride. For example, FIG. 3 illustrates an adjustable length support member directed to two sides or surfaces of the ride, and thus, utilizes two feet or other devices. The first support member, however, is directed to a single side or surface, and thus, utilizes a single claw. Similar to the claw of the first support member, the feet of the second support member can be rotated or adjusted as necessary.

Figure 14:
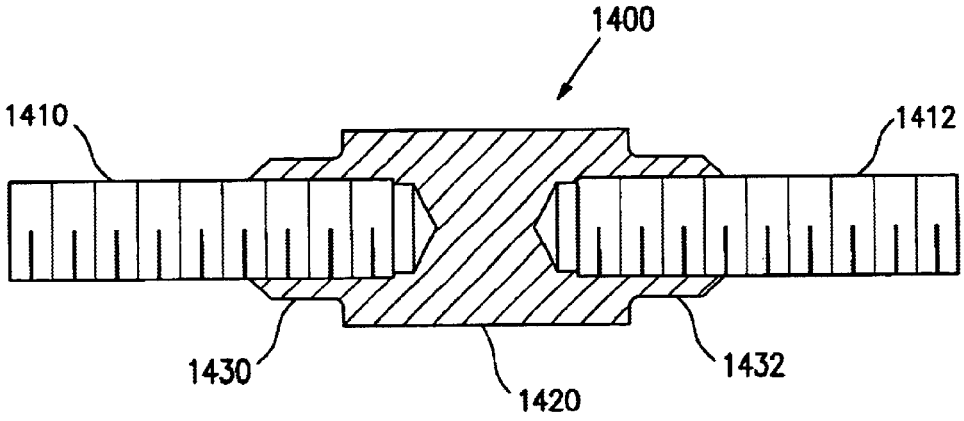
FIG. 14 is a side view of a tensioner used to secure a support member against a vehicle surface.

A tensioner can be used to tighten support members against a vehicle surface. FIG. 14 illustrates one example tensioner 1400 that can be utilized. The tensioner 1400 includes two threaded rod sections 1410, 1412. The threaded rod sections 1410, 1412 are incorporated into a machined tension housing 1420, e.g., a machined threaded turnbuckle housing. The ends 1430, 1432 of the machined tension housing 1420 are threaded such that the threaded rod sections 1410, 1412 can be adjusted in and out of the machined tension housing 1420. With proper adjustment, a support member is loaded against the surface or sides of the vehicle. The tensionor 1400 is configured to be incorporated into the inner barrel 1100. Referring back to FIG. 11A, the cavity 1102 is configured to accommodate tensioner 1400.

Having described the manner in which fixed-length support members 240 and adjustable-length support members 250 are configured within the mounting apparatus, those skilled in the art will recognize the many possible support member configurations. For example, the adjustable-length support members 250 can be replaced with fixed-length support members. The fixed-length support members can be replaced with adjustable-length support members. Further, a mounting apparatus could be configured with all fixed-length support members or all adjustable-length support members. The structural modifications to implement different mounting apparatus designs can be easily implemented.

Further mounting enhancements can also be utilized. For example, referring back to FIG. 2, levels can be used to assist a user in setting the mounting apparatus correctly. As illustrated, levels can be tubular levels, protractor levels, or other types of levels. Further, adjustable-length support members such as a telescoping arm may include one, two, or more inner barrels that can be extended as necessary to adjust the position of the accelerometer.

Having described the structural components of the mounting apparatus, following is a description of how the mounting apparatus can be used in practice to implement a motion detection system Implementation of Motion Detection System Considering the flexibility and ease of configuring and adjusting the mounting apparatus 200, the motion detection system can be adapted to many different rides.

Figure 15:
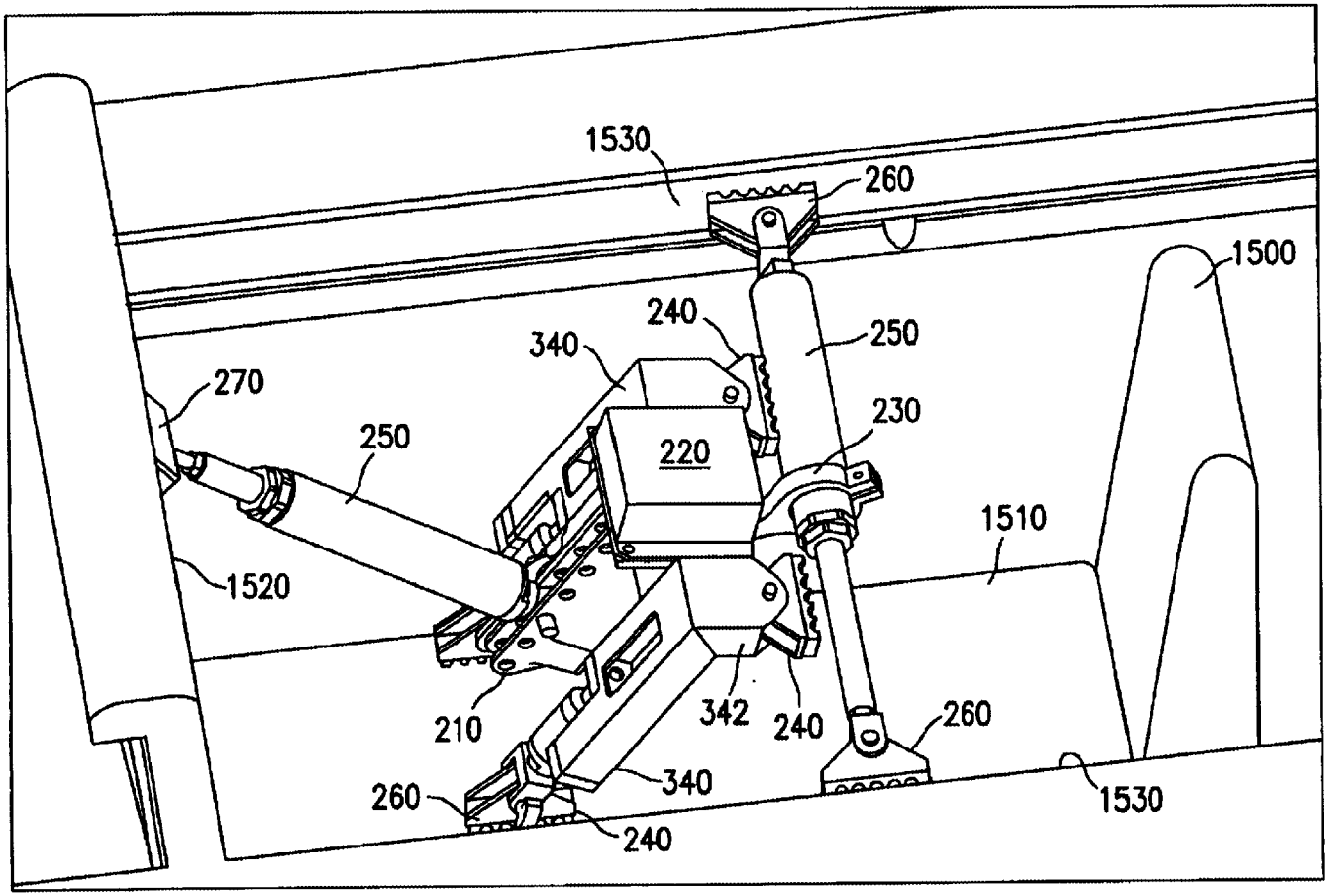
FIG. 15 is an illustration of an embodiment of a motion detection system secured against a seat, side walls, and a handle of a ride.

For example, FIG. 15 illustrates the motion detection system with a modified version of the mounting apparatus 200 illustrated in FIG. 3. The modified mounting apparatus is secured between a bottom seating surface 1510, the front of a ride, e.g., a rail or bar 1520 (not visible in FIG. 15), and the side walls or surfaces 1530 of the ride.

The mounting system utilized in FIG. 15 is the same mounting system 200 illustrated in FIG. 2 except that the coupler 230 and the second or side adjustable support member 250 are positioned differently. Instead of using a coupler 230 attached to the front of the base section 210, the coupler 230 is attached to the back of the base section 210. As a result, the second or side support member 250 is secured by the coupler 230 to the back of the base section 210. However, the same mounting apparatus illustrated in FIG. 3 can also be utilized by changing the coupler 230/adjustable-length support member 250 configuration.

Further, in FIG. 15, the fixed-length support members 240, e.g., back rests, coupled to the top tube section 342 are not placed against a back seating surface 1500 of the ride. However, the mounting apparatus 200 can be moved back such that the back rest of the top tube section 342 contacts the back seating surface 1500. In this case, the length of the first or front support member 250 is adjusted to account for the longer distance from the mounting apparatus 200 to the front 1520 of the ride. However, the second or side support member 250 would not be adjusted since this distances remains the same.

Figure 16:
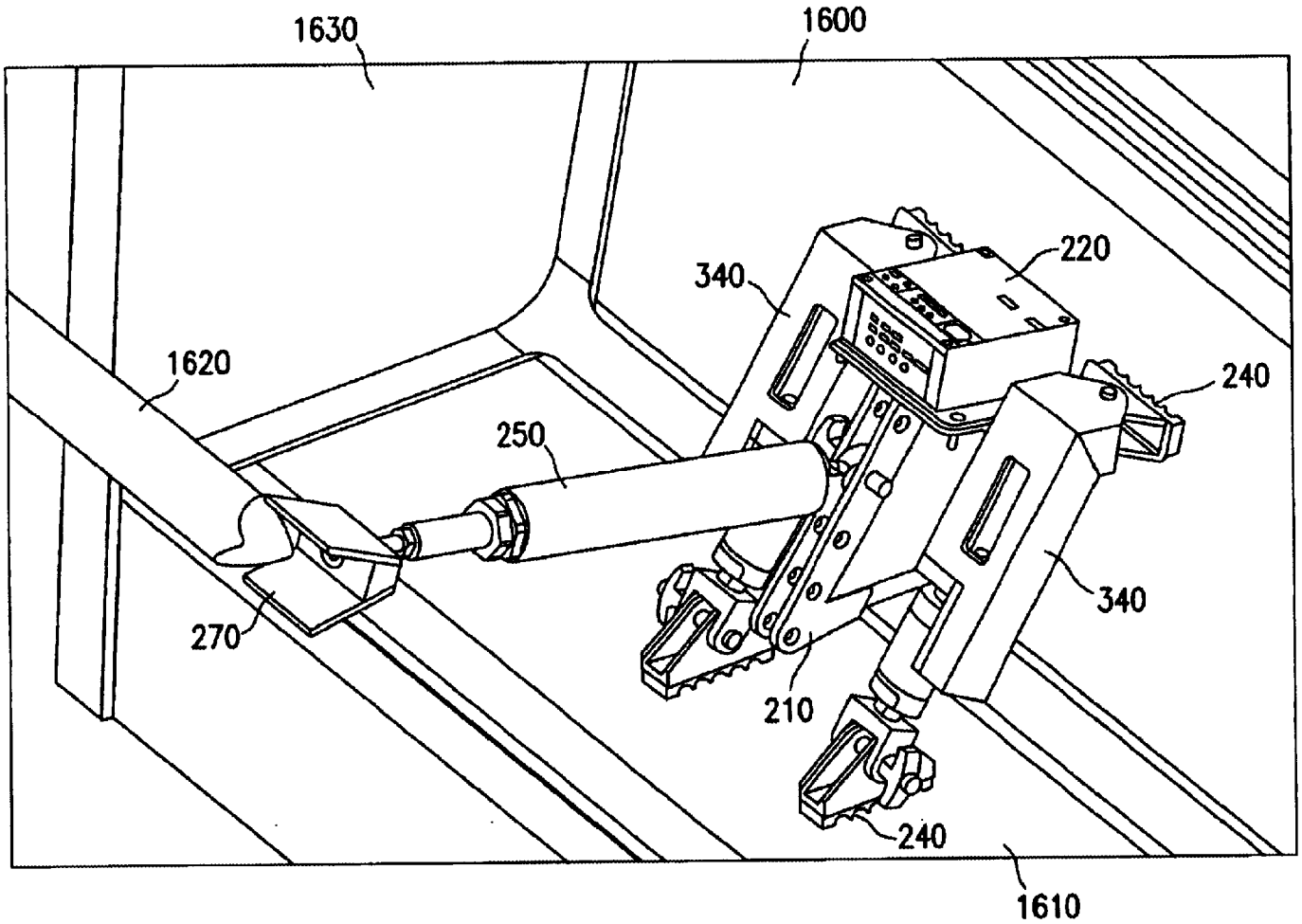
FIG. 16 is an illustration of an embodiment of a motion detection system secured against a seat and a handle of a ride.

As another example, FIG. 16 illustrates a motion detection system using a simplified version of the mounting apparatus 200 of FIG. 3. The mounting apparatus 200 is secured against a back seating surface 1600, a bottom seating surface 1610, and the front of the ride, e.g., a pole or rail 1620. In this configuration, the mounting system does not include a coupler 230. This configuration also lacks a support member secured by the coupler and between opposite sides 1630 of the ride.

Rather, fixed-length support members are in contact with back 1600 and bottom 1610 seating surfaces, and the adjustable-length support member 250 extends from the base section 210 to the front rail 270 of the ride. The claw 270 of the support member couples to a bar or pole to lock the support arm in place. Of course, the mounting apparatus could also include the second or side adjustable-length support member if further stabilization is desired. Indeed, various motion detection system and mounting apparatus configurations can be utilized, and the previous examples are merely illustrative of many possible options and configurations Utilizing the motion detection system as illustrated in FIGS. 15 and 16 provides accurate data reflecting forces at specific locations or upon specific portions of the body since the accelerometer is secured to prevent movements and jitters which may result in inaccurate data.

Initially, the accelerometer is secured to the mounting apparatus and positioned within range of an indicated reference point by positioning and adjusting support members as necessary. The reference point can be measured relative to surfaces of the ride or vehicle, e.g., relative to one or more seating or floor surfaces (in the event that a test is directed to a person standing on or in a vehicle or ride).

Figure 17:
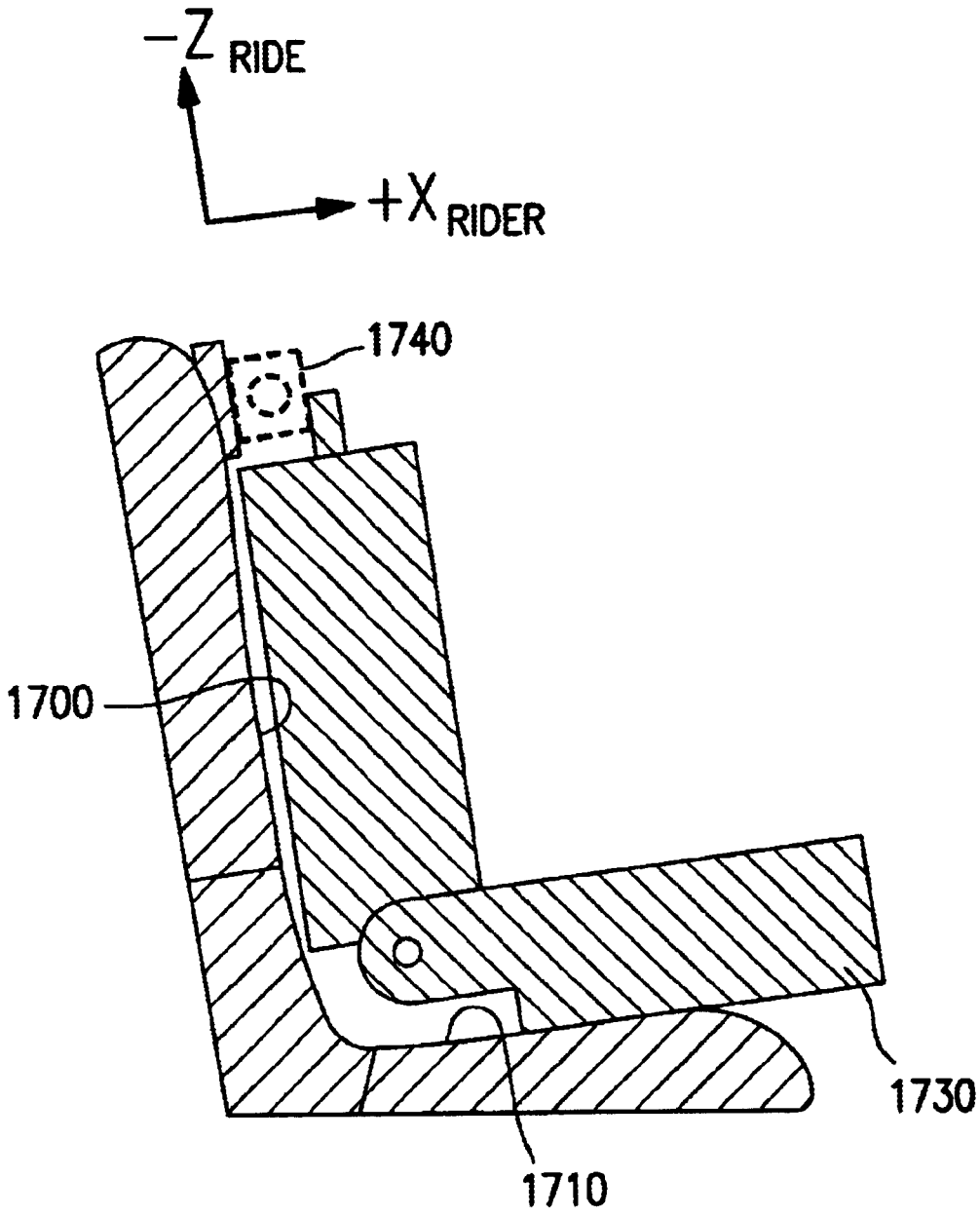
FIG. 17 is an illustration of a rider coordinate system which serves as a reference for a location of a motion detector.

For example, FIG. 17 represents a rider coordinate system with X (rider) and Z (ride) components relative to a back seating surface 1700 and a bottom seating surface 1710. A person that would occupy a seat with back 1700 and bottom 1710 seating surfaces is represented by block 1730. In a motion detection test relating to forces upon a rider's heart, the position of the heart is approximated to be between about 13 and 16 inches from the bottom or pan surface 1710 of the seat and between about 3 and 5 inches from the back seat surface. This reference point 1740 is represented by the dotted box in FIG. 17 and based on a "mean" sizing of the adult population of about 47 inches above the floor of the vehicle or ride. Of course, these approximations can be changed, and different approximations can correspond to different portions of the body besides the heart. Further, if children are evaluated, the approximations would likely be reduced to account for smaller heights.

The mounting apparatus is adjusted, and secured such that the accelerometer is positioned to the reference point 1740 approximating the location of the person's heart. The ride or vehicle is activated, and the accelerometer obtains motion and acceleration data. The data is evaluated to determine potential effects of the ride on a person's health—in this case, upon a person's heart. Other example reference points 1740 include the sternum, stomach, and head. Of course, the position of the accelerometer can be adjusted by repositioning or adjusting the mounting apparatus to correspond to a different portion of the body. As illustrated, the mounting system can be directed to the position of a person within a seat of the vehicle. However, the same system could be adapted to the position of a person standing within the vehicle. The mounting apparatus and motion detection system can be utilized in a wide variety of rides and vehicles to in many different positions to correspond to different portions of the body.

The flexibility of the mounting apparatus of the motion detection system is demonstrated in its ability to be secured to many different ride or vehicle configurations. For example, the mounting apparatus can be secured against two, three, or four or more surfaces of a ride or vehicle. Example configurations are explained in detail below.

As illustrated in FIG. 16, support members of the mounting apparatus can be secured against three ride surfaces. For example, support members can be extended, if necessary, from the base section to a front surface of the vehicle, from the base section to a bottom seat surface, and from the base section a back seating surface.

FIG. 15 illustrates that the mounting apparatus can be secured against four vehicle surfaces. For example, support members can be extended, if necessary, from the base section to a front surface of the vehicle, from the base section to a bottom seating surface, and from the base section to opposite side walls of the vehicle.

Further, the mounting system can be secured against five surfaces. For example, the mounting apparatus in FIG. 15 can be modified such that the coupler 230 and side support member are attached to the front of the base section 210. The mounting apparatus can then be moved back to the back seating surface 1500. As a result, support members can be extended, if necessary, from the base section to a front surface 1520 of the vehicle, to a bottom seating surface 1510, to opposite side walls 1530 of the vehicle, and against a back seating surface 1500.

Additional mounting apparatus adaptations are possible in the event that a ride or vehicle is not particularly suited for the mounting apparatus configurations previously illustrated and described. The previously described mounting apparatus are secured against three, four or five "clearly defined" surfaces such as a bar or side of the ride. Other attachment devices can be integrated into the mounting system to adapt to these types of rides and securely fasten and position an accelerometer for motion testing.

For example, the mounting apparatus can be adapted to rides with circular seating arrangements. One of the previously described mounting systems can be positioned such that two support members are placed against a bottom of a circular seating surface and two other support members are directed to back of a circular seating surface. The ride may include a middle portion, e.g., a handle or grab bar. Whether the mounting system can be secured to the middle handle depends on whether the middle handle moves relative to the seating surface.

More specifically, if the circular seating surface and the middle handle do not move relative to each other, i.e., they are fixed or move together, then a support member can be extended, as necessary, to the middle handle via a claw, hook, or other attachment.

However, if the middle handle and the circular ride carriage move relative to each other, e.g., the ride carriage rotates or spins around an axis about the middle handle, then securing a support member to the middle handle may not be effective. When the ride spins around the middle handle, the position of the front support member will move until it eventually becomes disconnected from the middle handle. To secure the mounting apparatus to these types of ride, the mounting apparatus can be modified such that attachment to the middle handle is not necessary. For example, assuming the circular ride is an open air ride and not enclosed, a strap can be placed around the ride, both ends of the strap being secured to the mounting apparatus. With this configuration, the mounting apparatus is secured against two ride surfaces, for example, back and bottom seating surfaces of the ride. The strap around the bottom and back seating surfaces secures the mounting apparatus in position.

The motion detection system can also be attached to other rides with irregular shapes such as a carousel. In contrast to a typical ride car or vehicle, a carousel does not provide back seating or side mounting surfaces. Rather, a carousel is typically configured with animal characters, a seat and a pole. The mounting apparatus of FIG. 16 can be modified and coupled to the carousel by removing the coupler 230 and second or side support member 250. The bottom support members are secured against a seating surface, and the back support members are secured against the pole. A strap is placed around carousel body and coupled to the mounting apparatus to secure the mounting apparatus in place.

Indeed, other ride or vehicle shapes and configurations may be tested using the motion detection system and a strap to secure the mounting apparatus as necessary.

The foregoing description of embodiments of the present invention have been presented for the purposes of illustration and description. It is not intended to be exhaustive or to limit the invention to the precise forms disclosed. Many modifications and variations are possible in light of the above teaching. For example, depending on the nature of the vehicle or ride tested, the mounting apparatus can include all fixed-length support members, all adjustable-length support members, or a combination thereof. Further, different lengths of support members can be utilized. Moreover, the mounting apparatus can be mounted to various vehicle or ride surfaces. Additionally, the mounting apparatus can position an accelerometer to monitor forces upon various portions of the body in addition to the heart. It is intended that the scope of the invention be limited not by this detailed description, but rather by the claims appended hereto.

What is claimed is:

1. An apparatus for securing a motion detector in a vehicle, comprising:

a base section configured to lock the motion detector; and a plurality of support members secured between the base section and one or more surfaces of the vehicle, the support members being arranged to maintain the motion detector in a predetermined location based on a position of a person that would occupy the vehicle.

2. The apparatus of claim 1, the base section further comprising:

one or more plates, and a flange, wherein the flange is attached to the one or more plates and the motion detector is secured to the flange.

3. The apparatus of claim 1, wherein one of the plurality of support members comprises a fixed-length support member in contact with one or more of the vehicle surfaces.

4. The apparatus of claim 3, wherein an end of the fixed-length support member in contact with the one or more vehicle surfaces includes a foot.

5. The apparatus of claim 4, wherein the foot is adjustable.

6. The apparatus of claim 5, wherein the foot is adjustable in two dimensions.

7. The apparatus of claim 4, wherein the foot includes a cushion to prevent movement of the end of the fixed-length support member along the one or more vehicle surfaces.

8. The apparatus of claim 1, wherein one or more of the plurality of support members comprises an adjustable-length support member in contact with one or more of the vehicle surfaces.

9. The apparatus of claim 8, wherein the adjustable-length support member comprises a telescoping arm.

10. The apparatus of claim 8, wherein the adjustable-length support member is adjusted in two dimensions.

11. The apparatus of claim 8, wherein the adjustable-length support member is adjusted in three dimensions.

12. The apparatus of claim 8, wherein an end of the adjustable-length support member in contact with the one or more vehicle surfaces includes a foot.

13. The apparatus of claim 12, wherein the foot is adjustable.

14. The apparatus of claim 13, wherein the foot is adjustable in two dimensions.

15. The apparatus of claim 12, wherein the foot includes a cushion to prevent movement of the end of the adjustable-length support member along the one or more vehicle surfaces.

16. The apparatus of claim 8, wherein one of the adjustable-length support members includes a coupling device to stabilize the adjustable-length support member against the one or more vehicle surfaces.

17. The apparatus of claim 16, wherein the coupling device comprises a claw.

18. The apparatus of claim 16, wherein the coupling device comprises a hook.

19. The apparatus of claim 16, wherein the coupling device is secured to a bar in the vehicle.

20. The apparatus of claim 16, wherein the coupling device is secured to a portion of the vehicle located opposite of a seating surface of the vehicle.

21. The apparatus of claim 1, wherein one of the plurality of support members comprises a support strap.

22. The apparatus of claim 21, wherein the support strap is adjustable.

23. The apparatus of claim 21, wherein the support strap is placed around the vehicle.

24. The apparatus of claim 1, wherein the vehicle surface comprises a seating surface.

25. The apparatus of claim 24, wherein the seating surface comprises a back seating surface.

26. The apparatus of claim 24, wherein the seating surface comprises a bottom seating surface.

27. The apparatus of claim 1, wherein one of the vehicle surfaces comprises a bar of the vehicle.

28. The apparatus of claim 1, wherein one of the vehicle surfaces comprises a floor of the vehicle.

29. The apparatus of claim 1, wherein the plurality of support members are coupled between the base section and two surfaces of the vehicle.

30. The apparatus of claim 1, wherein one of the plurality of support members extends from the base section to a bottom seating surface of the vehicle, wherein one of the plurality of support members extends from the base section to a back seating surface of the vehicle, and wherein one of the plurality of support members comprises a support strap, the support strap being placed around the vehicle and the base to secure the base and the support members.

31. The apparatus of claim 1, wherein the plurality of support members are coupled between the base section and three surfaces of the vehicle.

32. The apparatus of claim 31, wherein one of the plurality of support members extends from the base section to a front surface of the vehicle, wherein one of the plurality of support members extends from the base section to a bottom seating surface of the vehicle, and wherein one of the plurality of support members extends from the base section to a back seating surface of the vehicle.

33. The apparatus of claim 1, wherein the support members are coupled between the base section and four surfaces of the vehicle.

34. The apparatus of claim 33, the base section further comprising a coupler, wherein one of the plurality of support members extends from the base section to a front surface of the vehicle, wherein one of the plurality of support members extends from the base section to a bottom seating surface of the vehicle, and wherein one of the plurality of support members extends from the coupler attached to the base section to opposite side surfaces of the vehicle.

35. The apparatus of claim 1, wherein the predetermined location based on the position of the person that would occupy the vehicle is based on the person sitting in a seat of the vehicle.

36. The apparatus of claim 35, wherein the predetermined location comprises a distance of about 15 inches above a bottom surface of the seat and about 4 inches from a back surface of the seat.

37. The apparatus of claim 1, wherein the predetermined location based on the position of the person that would occupy the vehicle is based on the person standing on a floor of the vehicle.

38. The apparatus of claim 37, wherein the predetermined location comprises a distance of about 47 inches above the floor of the vehicle.

39. The apparatus of claim 1, wherein the predetermined location based on the position of the person that would occupy the vehicle comprises a base of a chest of the person.

40. The apparatus of claim 1, wherein the predetermined location based on the position of the person that would occupy the vehicle comprises a heart of the person.

41. The apparatus of claim 1, wherein the predetermined location based on the position of the person that would occupy the vehicle comprises a head of the person.

42. The apparatus of claim 1, wherein the predetermined location based on the position of the person that would occupy the vehicle comprises a stomach of the person.

43. The apparatus of claim 1, wherein the vehicle comprises an automobile.

44. The apparatus of claim 1, wherein the vehicle comprises a ride.

45. The apparatus of claim 1, wherein the motion detector comprises an accelerometer.

46. The apparatus of claim 1, wherein the motion detector comprises a transducer.

47. A mounting system for securing an accelerometer to a vehicle, comprising:

a base section, the accelerometer being attached to the base section;

an extendable support member coupled to the base section and directed to a front section of the vehicle; and a plurality of support members directed to a bottom seating surface and to a back seating surface of the vehicle, wherein a length of the extendable support member is adjusted such that all of the support members contact respective surfaces of the vehicle to lock the accelerometer in a predetermined position corresponding to a location of a person sitting in the vehicle.

48. A mounting system for securing an accelerometer to a vehicle, comprising:

a base section, the accelerometer being attached to the base section;

a coupler attached to the base section;

a plurality of extendable support members, wherein one of the extendable support members is coupled to the base section and directed to a front section of the vehicle, wherein one of the extendable support members is secured by the coupler attached to the base section and directed to opposite sides of the vehicle; and a plurality of support members directed to a bottom seating surface and a back seating surface of the vehicle, wherein a length of the extendable support members is adjusted such that all of the support members contact respective vehicle surfaces to lock the accelerometer into a predetermined position corresponding to a location of a person sitting in the vehicle.

49. A mounting system for securing an accelerometer to a vehicle, comprising:

a base section, the accelerometer being attached to the base section; and a plurality of support members coupled to the base section, wherein two of the plurality of support members are directed to a bottom seating surface of the vehicle, wherein two of the plurality of support members are directed to a back seating surface of the vehicle, wherein one of the plurality of support members comprises a support strap, the support strap being placed around the vehicle, wherein a length of the support members is adjusted such that all of the support members contact their respective vehicle surfaces to lock the accelerometer into a predetermined position corresponding to a location of a person sitting in the vehicle.

50. A motion detection system, comprising:

a motion detector;

a base section, the motion detector being locked to the base section; and a plurality of support members coupled between the base section and the vehicle, wherein at least one of the support members is adjusted such that all of the plurality of support members contact their respective vehicle surfaces to secure the motion detector into a predetermined position corresponding to a position of a person that would occupy the vehicle.

51. The motion detection system of claim 50, wherein the support member that is adjusted comprises a telescoping support, the telescoping support being directed to a front surface of the vehicle and adjusted such that all of the support members contact their respective surfaces.

52. The motion detection system of claim 51, further comprising:

a coupler attached to the base section; and an additional telescoping support, the additional telescoping support being secured by the coupler, wherein each end of the additional telescoping support is directed to opposite sides of the vehicle.

53. The motion detection system of claim 50, wherein one of the support members comprises a strap, the strap being placed around the vehicle such that all of the support members contact their respective surfaces and secure the motion detector into the predetermined location.

54. The motion detection system of claim 50, wherein the predetermined location is based on a person sitting in the vehicle.

55. The motion detection system of claim 54, wherein the predetermined location comprises a distance of about 15 inches above a bottom seating surface of the vehicle and about 4 inches from a back seating surface of the vehicle.

56. The motion detection system of claim 50, wherein the predetermined location is based on a person standing on a floor of the vehicle.

57. The motion detection system of claim 56, wherein the predetermined location comprises a distance of about 47 inches above the floor of the vehicle.

58. The motion detection system of claim 50, wherein the predetermined position comprises a base of a chest of the person.

59. The motion detection system of claim 50, wherein the predetermined position comprises a heart of the person.

60. The motion detection system of claim 50, wherein the predetermined position comprises a head of the person.

61. The motion detection system of claim 50, wherein the predetermined position comprises a stomach of the person.

62. The motion detection system of claim 50, wherein the vehicle comprises an automobile.

63. The motion detection system of claim 50, wherein the vehicle comprises a ride.

64. The motion detection system of claim 50, wherein the motion detector comprises an accelerometer.

65. The motion detection system of claim 50, wherein the motion detector comprises a transducer.

66. A method of securing a motion detector in a predetermined position within a vehicle, comprising:

mounting the motion detector to a base section of a mounting assembly;

directing a plurality of support members coupled to the base section of the mounting assembly to respective surfaces of the vehicle;

adjusting an extendable support member of the plurality of support members such that all of the plurality of support members are secured against respective vehicle surfaces; and locking the extendable support member such that all of the plurality of support members are secured to lock the motion detector in the predetermined position.

67. The method of claim 66, wherein adjusting the extendable support member further comprises adjusting a telescoping support.

68. The method of claim 66, wherein adjusting the extendable support member further comprises adjusting a length of a strap placed around the vehicle.

69. The method of claim 66, wherein locking the extendable support member further comprises locking the motion detector into a location based on a person sitting in a seat of the vehicle.

70. The method of claim 69, wherein locking the motion detector into the location based on the person sitting in the seat further comprises locking the motion detector at a distance of about 15 inches above a bottom seating surface and about 4 inches from a back seating surface.

71. The method of claim 66, wherein locking the extendable support member further comprises locking the motion detector into a location based on a person standing in the vehicle.

72. The method of claim 71, wherein locking the motion detector into the location based on the person standing in the vehicle comprises locking the motion detector at a height of about 47 inches above a floor of the vehicle.

73. The method of claim 66, wherein the vehicle comprises an automobile.

74. The method of claim 66, wherein the vehicle comprises a ride.

75. The method of claim 66, wherein the motion detector comprises an accelerometer.

76. The method of claim 66, wherein the motion detector comprises a transducer.

* * * * *